US012194358B2

(12) United States Patent
Kim

(10) Patent No.: US 12,194,358 B2
(45) Date of Patent: Jan. 14, 2025

(54) WHEELCHAIR TREADMILL

(71) Applicant: KANGSTERS CORP., Ansan-si (KR)

(72) Inventor: Kang Kim, Ansan-si (KR)

(73) Assignee: KANGSTERS CORP., Ansan-si (KR)

( * ) Notice: Subject to any disclaimer, the term of this patent is extended or adjusted under 35 U.S.C. 154(b) by 0 days.

(21) Appl. No.: 18/015,284

(22) PCT Filed: Aug. 23, 2022

(86) PCT No.: PCT/KR2022/012590
§ 371 (c)(1),
(2) Date: Jan. 9, 2023

(87) PCT Pub. No.: WO2023/106557
PCT Pub. Date: May 15, 2023

(65) Prior Publication Data

US 2024/0238659 A1 Jul. 18, 2024

(30) Foreign Application Priority Data

Dec. 7, 2021 (KR) ..... 10-2021-0173405

(51) Int. Cl.
*A63B 69/16* (2006.01)
*A63B 22/00* (2006.01)
(Continued)

(52) U.S. Cl.
CPC ..... *A63B 69/16* (2013.01); *A63B 22/0002* (2013.01); *A63B 22/02* (2013.01); *A63B 71/0009* (2013.01); *A63B 2071/0018* (2013.01)

(58) Field of Classification Search
CPC ..... A63B 2069/161–168
See application file for complete search history.

(56) References Cited

U.S. PATENT DOCUMENTS 4,911,425 A * 3/1990 Kynast ..... A63B 71/0009 482/904
4,966,362 A * 10/1990 Ramaekers ..... A63B 71/0009 482/148
(Continued)

FOREIGN PATENT DOCUMENTS

DE 2833354 A1 * 7/1978
DE 4215879 A1 * 1/1993 ..... A63B 23/14
(Continued)

OTHER PUBLICATIONS

Google Translation KR 101993176 B1 (Jun. 13, 2024) (Year: 2024).*
Google Translation KR200479667 Y1 (Jun. 13, 2024) (Year: 2024).*

*Primary Examiner* — Nyca T Nguyen
(74) *Attorney, Agent, or Firm* — Sughrue Mion, PLLC

(57) ABSTRACT

The present disclosure relates to a wheelchair treadmill that helps a wheelchair user do an aerobic exercise by rolling driving wheels of a wheelchair in place while in the wheelchair. One embodiment of the present disclosure provides a wheelchair treadmill that supports home fitness of a wheelchair user, the wheelchair treadmill including: a footplate portion configured to assist entry or exit of a wheelchair; a roller portion which has a plurality of roller members disposed in parallel corresponding to first and second driving wheels of the wheelchair and configured to roll in a predetermined rolling direction due to rolling of each of the first and second driving wheels; a support portion coupled to one side of the footplate portion and configured to rollably support the plurality of roller members; and a brake portion rotatably coupled to the support portion and configured to stop the roller portion by being coupled to a rolling shaft of the roller members.

4 Claims, 4 Drawing Sheets

(51) Int. Cl.
*A63B 22/02* (2006.01)
*A63B 71/00* (2006.01)

(56) References Cited

U.S. PATENT DOCUMENTS

| | | | | | |
|---|---|---|---|---|---|
| 5,643,143 | A * | 7/1997 | Burak | A63B 71/0009 | 482/904 |
| 5,649,883 | A * | 7/1997 | Mayes | A63B 71/0009 | 482/904 |
| 5,704,876 | A * | 1/1998 | Baatz | A63B 21/0052 | 482/61 |
| 6,113,519 | A * | 9/2000 | Goto | A63B 71/0009 | 482/54 |
| 6,645,127 | B1 * | 11/2003 | Pestes | A63B 71/0009 | 482/904 |
| 7,004,885 | B1 * | 2/2006 | Wu | A63B 22/0292 | 482/4 |
| 7,874,962 | B1 * | 1/2011 | Pestes | A63B 22/02 | 482/904 |
| 10,232,245 | B2 * | 3/2019 | Pestes | A63B 21/4049 | |
| 2011/0015045 | A1 * | 1/2011 | Pestes | A63B 22/0005 | 482/51 |

FOREIGN PATENT DOCUMENTS

| | | | | | |
|---|---|---|---|---|---|
| FR | 2534806 | A * | 4/1984 | A63B 23/12 | |
| KR | 10-2007-0098302 | A | 10/2007 | | |
| KR | 10-1365934 | B1 | 2/2014 | | |
| KR | 20-0479667 | Y1 | 2/2016 | | |
| KR | 10-1993176 | B1 | 6/2019 | | |
| WO | WO-9619264 | A1 * | 6/1996 | A63B 24/00 | |

* cited by examiner

[FIG. 1]
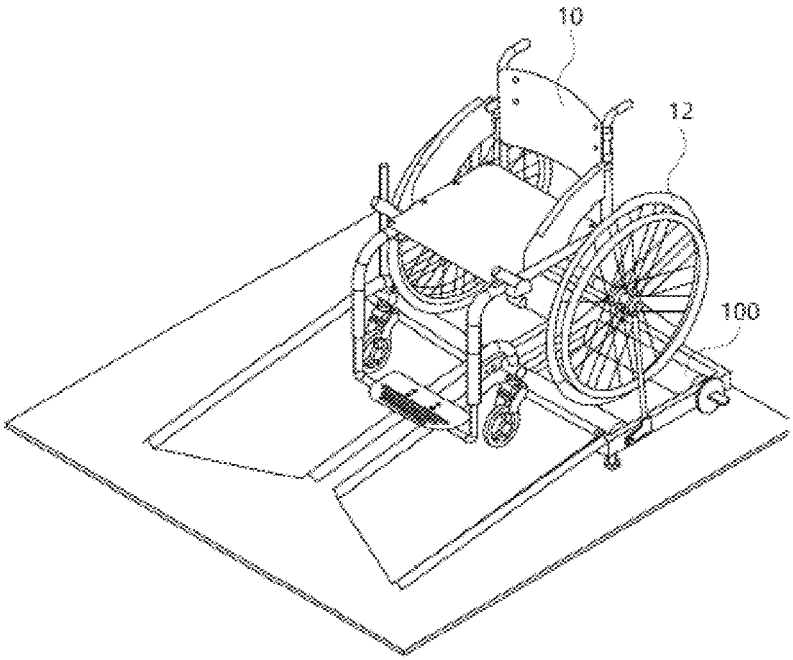
[FIG. 2]
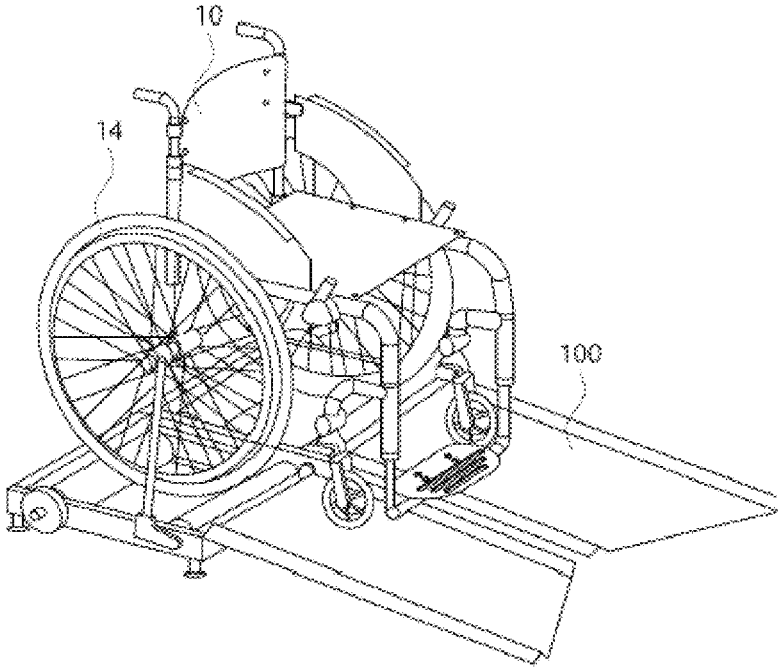

[FIG. 3]
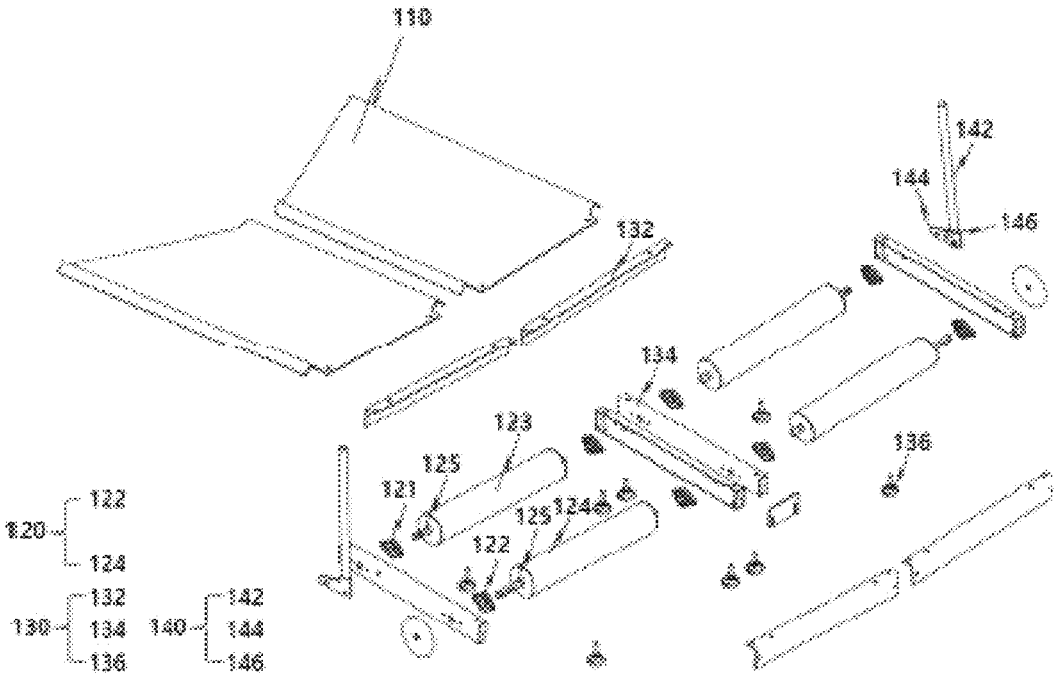
[FIG. 4]
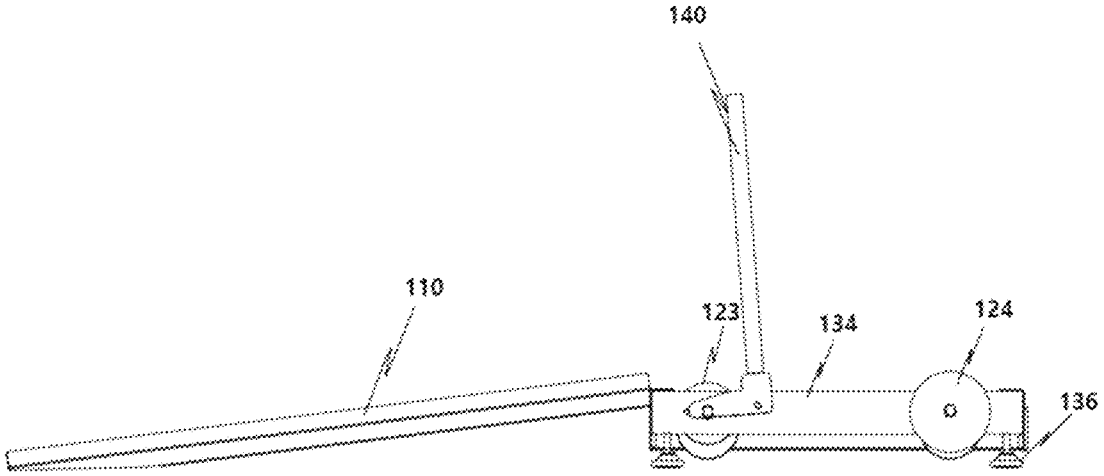

[FIG. 5]
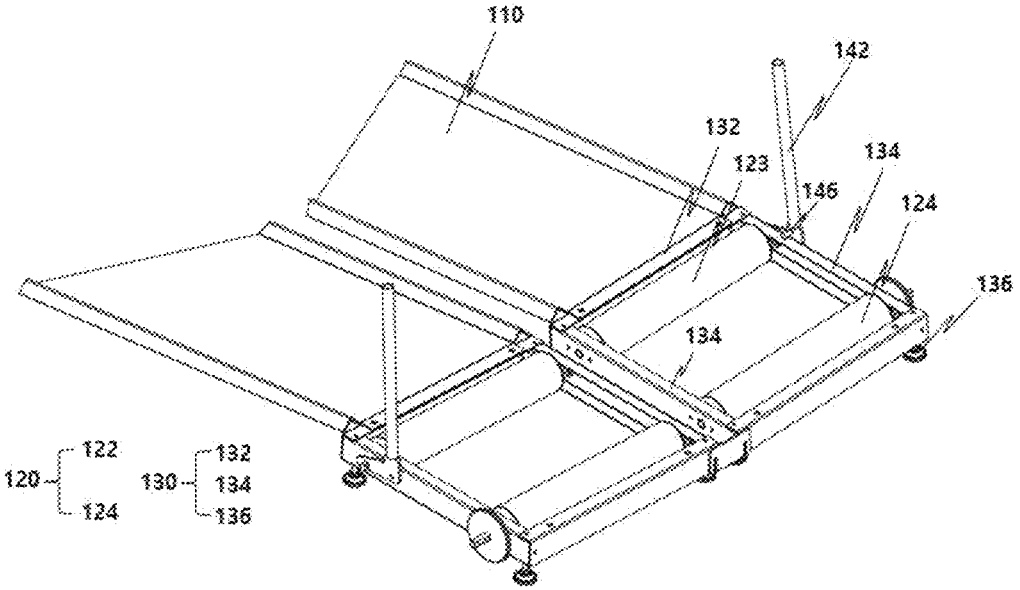
[FIG. 6]
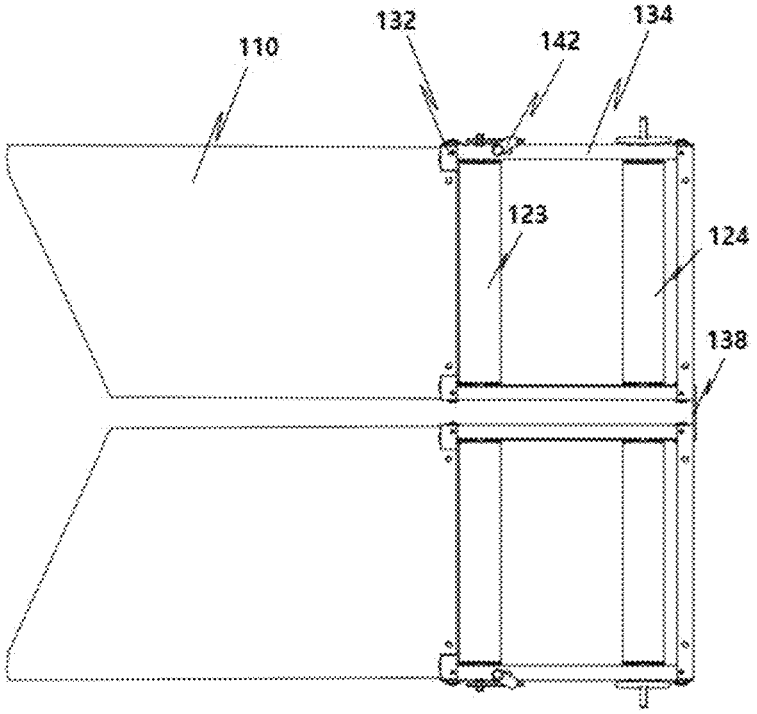

[FIG. 7]
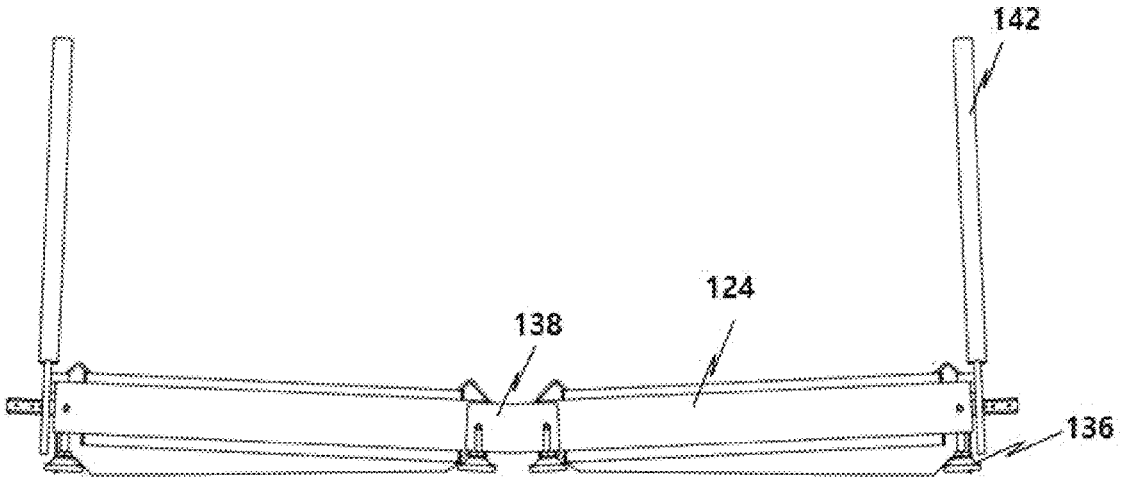
[FIG. 8]
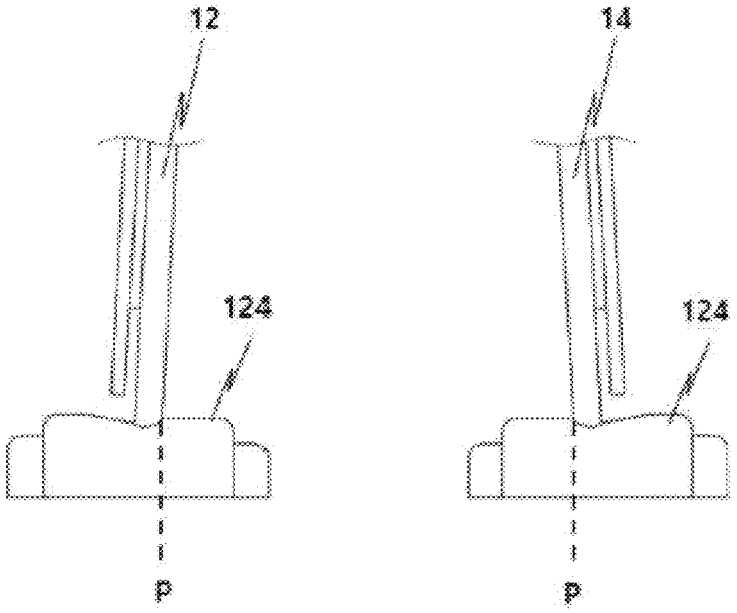

WHEELCHAIR TREADMILL

CROSS REFERENCE TO RELATED APPLICATIONS

This application is a National Stage of International Application No. PCT/KR2022/012590 filed Aug. 23, 2022, claiming priority based on Korean Patent Application No. 10-2021-0173405 filed Dec. 7, 2021.

TECHNICAL FIELD

The present disclosure relates to a wheelchair treadmill, and more particularly, to a wheelchair treadmill that helps a wheelchair user do an aerobic exercise by rolling driving wheels of a wheelchair in place while in the wheelchair.

BACKGROUND ART

Wheelchairs are used by patients, people with disabilities, or the elderly to move. A wheelchair may be driven by the occupant directly rolling the wheels or may be driven by a caregiver pushing the wheelchair.

In the case in which a wheelchair is driven by a caregiver pushing the wheelchair, the occupant hardly exercises, and thus, the longer the occupant uses the wheelchair, the more the occupant lacks exercise.

Also, rolling wheels of a wheelchair by hand requires considerable upper-body strength, and a wheelchair user should do an upper body exercise. However, even if people with disabilities or people receiving rehabilitation therapy want to exercise, there is no fitness center or gym available for their use. In addition, fitness equipment provided in nearby sports parks is generally difficult to use due to being manufactured according to the standard of able-bodied people.

In order to address such problems, an apparatus that utilizes a wheelchair and supports an arm exercise for people with disabilities has been proposed in the past. However, the conventional apparatus for an arm exercise for people with disabilities who use wheelchairs is just for developing arm strength without practicing driving a wheelchair by rolling the wheels of the wheelchair and thus has a disadvantage that it is difficult to actually roll the wheels of the wheelchair and drive the wheelchair.

DISCLOSURE

Technical Problem

The present disclosure is directed to providing a wheelchair treadmill that helps a wheelchair user do an aerobic exercise by rolling driving wheels of a wheelchair in place while in the wheelchair.

The present disclosure is also directed to providing a wheelchair treadmill that allows a wheelchair user to learn how to do an arm exercise and roll wheels of a wheelchair in a limited space.

The present disclosure is also directed to providing a wheelchair treadmill that uses a slope of a roller member to prevent slippage of wheels.

The present disclosure is also directed to providing a wheelchair treadmill that can be driven continuously and stably using a brake structure that is coupled to a rolling shaft.

Objectives of the present disclosure are not limited to those mentioned above, and other unmentioned objectives should be clearly understood by those of ordinary skill in the art to which the present disclosure pertains from the description below.

Technical Solution

One embodiment of the present disclosure provides a wheelchair treadmill that supports home fitness of a wheelchair user, the wheelchair treadmill including: a footplate portion configured to assist entry or exit of a wheelchair; a roller portion which has a plurality of roller members disposed in parallel corresponding to first and second driving wheels of the wheelchair and configured to roll in a predetermined rolling direction due to rolling of each of the first and second driving wheels: a support portion coupled to one side of the footplate portion and configured to rollably support the plurality of roller members; and a brake portion rotatably coupled to the support portion and configured to stop the roller portion by being coupled to a rolling shaft of the roller members.

In an embodiment of the present disclosure, the roller portion may include: a pair of first bearings installed at a front end of the support portion that is adjacent to the footplate portion: a pair of second bearings spaced apart at a predetermined distance from each of the pair of first bearings and installed at a rear end of the support portion: a first roller member rollably mounted on each of the pair of first bearings: and a second roller member rollably mounted on each of the pair of second bearings.

In an embodiment of the present disclosure, the first roller member and the second roller member may each include a rolling shaft configured to be inserted into the first bearing and roll and a roller body configured to roll about the rolling shaft.

In an embodiment of the present disclosure, the first roller member and the second roller member may each be installed to have a structure that forms a slope at a predetermined angle from an inner side of each of the first and second driving wheels toward an outer side thereof to prevent slippage of the first and second driving wheels.

In an embodiment of the present disclosure, the first roller member and the second roller member may each form a slope at a predetermined angle due to an outer side of each of the first and second driving wheels, which are seated on each of the first roller member and the second roller member, being disposed higher from the ground than an inner side thereof due to the support portion.

In an embodiment of the present disclosure, the first roller member and the second roller member may each be formed so that a diameter changes with respect to a predetermined point and may form a slope at an angle that is upward from an inner side of each of the first and second driving wheels, which are seated on each of the first roller member and the second roller member, toward an outer side thereof.

In an embodiment of the present disclosure, the support portion may include: a first support member extending in a width direction of the footplate portion and coupled to one side of the footplate portion in a longitudinal direction of the footplate portion: a pair of second support members extending in the longitudinal direction of the footplate portion and coupled to both sides of the first support member while being spaced apart at a predetermined distance therefrom; and a plurality of third support members coupled to a lower surface of each of the pair of second support members and configured to support the pair of second support members at a predetermined height from the ground.

In an embodiment of the present disclosure, the brake portion may include: a lever having one side rotatably coupled to the support portion and the other side extending to be operated by a user: a coupling portion coupled to the rolling shaft of the first roller member and configured to stop rolling of the first roller member by being directly coupled to the rolling shaft of the first roller member due to operation of the lever; and a rolling prevention pin configured to designate or limit a movement range of the lever.

Advantageous Effects

According to an embodiment of the present disclosure, a wheelchair treadmill can help a wheelchair user do an aerobic exercise by rolling driving wheels of a wheelchair in place while in the wheelchair.

Also, according to an embodiment of the present disclosure, a wheelchair treadmill can allow a wheelchair user to learn how to do an arm exercise and roll wheels of a wheelchair in a limited space.

Also, according to an embodiment of the present disclosure, a wheelchair treadmill can use a slope of a roller member to prevent slippage of wheels.

Also, according to an embodiment of the present disclosure, a wheelchair treadmill can be driven continuously and stably using a disc-type brake structure that comes in close contact in an axial direction.

Also, according to an embodiment of the present disclosure, a wheelchair treadmill can be driven continuously and stably using a brake structure that is coupled to a rolling shaft.

Advantageous effects of the present disclosure are not limited to those mentioned above and should be understood as including all advantageous effects inferable from the detailed description of the present disclosure or the configuration of the disclosure stated in the claims.

DESCRIPTION OF DRAWINGS

FIGS. 1 and 2 are views illustrating a state in which a wheelchair is seated on a wheelchair treadmill according to one embodiment of the present disclosure.

FIGS. 3 to 6 are views illustrating a configuration of the wheelchair treadmill according to one embodiment of the present disclosure.

FIGS. 7 and 8 are views illustrating an embodiment of a roller portion.

MODES OF THE INVENTION

Hereinafter, the present disclosure will be described with reference to the accompanying drawings. However, the present disclosure may be implemented in various different forms and thus is not limited to the embodiments described herein. Also, for clear description of the present disclosure, parts unrelated to the description are omitted from the drawings, and like parts are denoted by like reference numerals throughout the specification.

Throughout the specification, when a certain part is described as being "connected (linked, in contact with, coupled)" to another part, this not only includes a case where the two parts are "directly connected," but also includes a case where the two parts are "indirectly connected" while another element is disposed therebetween. Also, when a certain part is described as "including" a certain element, unless otherwise stated, it means that the certain part may further include another element instead of excluding other elements.

Terms used herein are merely used to describe specific embodiments and are not intended to limit the present disclosure. A singular expression includes a plural expression unless the context clearly indicates otherwise. In this application, terms such as "include" or "have" should be understood as specifying that features, numbers, steps, operations, elements, components, or combinations thereof are present and not as precluding the possibility of the presence or addition of one or more other features, numbers, steps, operations, elements, components, or combinations thereof in advance.

Hereinafter, embodiments of the present disclosure will be described in detail with reference to the accompanying drawings.

FIGS. 1 and 2 are views illustrating a state in which a wheelchair is seated on a wheelchair treadmill according to one embodiment of the present disclosure. FIGS. 3 to 6 are views illustrating a configuration of the wheelchair treadmill according to one embodiment of the present disclosure. FIGS. 7 and 8 are views illustrating an embodiment of a roller portion.

Referring to FIGS. 1 to 8, in order to support home fitness of a wheelchair user, a wheelchair treadmill 100 according to one embodiment of the present disclosure may include a footplate portion 110 configured to assist entry or exit of a wheelchair 10, a roller portion 120 which has a plurality of roller members 123 and 124 disposed in parallel corresponding to first and second driving wheels 12 and 14 of the wheelchair 10 and configured to roll in a predetermined rolling direction due to rolling of each of the first and second driving wheels 12 and 14, a support portion 130 coupled to one side of the footplate portion 110 and configured to rollably support the plurality of roller members 123 and 124, and a brake portion 140 rotatably coupled to the support portion 130 and configured to stop the roller portion 120 while in close contact therewith in an axial direction.

In particular, in the wheelchair treadmill according to one embodiment of the present disclosure, the footplate portion 110, the roller portion 120, the support portion 130, and the brake portion 140 may each be provided in a set of two to correspond to each of the first and second driving wheels 12 and 14. For example, the footplate portion 110, the roller portion 120, the support portion 130, and the brake portion 140 may each be provided as a set of a first portion disposed at a left side and a second portion disposed at a right side. Here, regarding the support portion 130, the first portion and the second portion may be coupled while spaced apart at a predetermined distance from each other using a connecting member 138.

Specifically, the footplate portion 110 may be formed to be inclined at a predetermined angle (e.g., about 5° to 30°) and support entry of the wheelchair 10 toward the roller portion 120 or exit of the wheelchair 10 from the roller portion 120. Concave and convex portions may be formed on an upper surface of the footplate portion 110 to prevent slippage of the first and second driving wheels 12 and 14 of the wheelchair 10.

Also, the footplate portion 110 may include a guideline (not illustrated) formed to protrude from each of both side ends and may prevent the first and second driving wheels 12 and 14 from deviating.

Also, the footplate portion 110 may have one side detachably coupled to the support portion 130. In this way, there are advantages that the footplate portion 110 can be separated from the support portion 130 when not in use, can be easily stored, and can be conveniently replaced when a defect occurs.

The roller portion 120 is rollably coupled to the support portion 130 and supports the wheelchair 10, entering through the footplate portion 110, to allow the first and second driving wheels 12 and 14 to roll (in place). That is, in a case in which a user rolls the first and second driving wheels 12 and 14 after placing the wheelchair 10 above the roller portion 120, the roller portion 120 is engaged with the first and second driving wheels 12 and 14 and rolls. In this way, the roller portion 120 may support the user to do an arm exercise like rolling the first and second driving wheels 12 and 14 in place.

To this end, the roller portion 120 may include a pair of first bearings 121 installed at a front end of the support portion 130 that is adjacent to the footplate portion 110, a pair of second bearings 122 spaced apart at a predetermined distance from each of the pair of first bearings 121 and installed at a rear end of the support portion 130, a first roller member 123 rollably mounted on each of the pair of first bearings 121, and a second roller member 124 rollably mounted on each of the pair of second bearings 122.

Here, the first roller member 123 and the second roller member 124 may each include a rolling shaft 125 configured to be inserted into the first bearing 121 and roll and a roller body 126 configured to roll about the rolling shaft 125. Here, the roller body 126 may be formed to be longer than a width of each of the first and second driving wheels 12 and 14 to stably support the first and second driving wheels 12 and 14 placed thereon.

The first roller member 123 and the second roller member 124 may each be installed to have a structure that forms a slope at a predetermined angle from an inner side of each of the first and second driving wheels 12 and 14 toward an outer side thereof to prevent slippage of the first and second driving wheels 12 and 14.

Referring to FIG. 7, according to a first embodiment, the first roller member 123 and the second roller member 124 may each form a slope at a predetermined angle due to an outer side of each of the first and second driving wheels 12 and 14, which are seated on each of the first roller member 123 and the second roller member 124, being disposed higher from the ground than an inner side thereof due to the support portion 130.

Also, referring to FIG. 8, according to a second embodiment, the first roller member 123 and the second roller member 124 may each be formed so that a diameter changes with respect to a predetermined point P and may form a slope at an angle that is upward from an inner side of each of the first and second driving wheels 12 and 14, which are seated on each of the first roller member 123 and the second roller member 124, toward an outer side thereof.

The support portion 130 may be coupled to one side of the footplate portion 110 and rollably support the roller portion 120. To this end, the support portion 130 may include a first support member 132 extending in a width direction of the footplate portion 110 and coupled to one side of the footplate portion 110 in a longitudinal direction of the footplate portion 110, a pair of second support members 134 extending in the longitudinal direction of the footplate portion 110 and coupled to both sides of the first support member 132 while being spaced apart at a predetermined distance therefrom, and a plurality of third support members 136 coupled to a lower surface of each of the pair of second support members 134 and configured to support the pair of second support members 134 at a predetermined height from the ground.

Here, the first bearing 121 and the second bearing 122 may be installed in each of the pair of second support members 134.

Also, the plurality of third support members 136 may be coupled to a front end and a rear end of each of the pair of second support members 134 and may each support the pair of second support members 134 at a predetermined height. In this way, the plurality of third support members 136 may cause the outer side of each of the first and second driving wheels 12 and 14, which are seated on each of the first roller member 123 and the second roller member 124, to be disposed higher than the inner side thereof. Also, the plurality of third support members 136 may support the rear end of each of the pair of second support members 134 to be higher than the front end thereof to form a rear inclined structure. The plurality of third support members 136 may be coupled to the second support members 134 using at least one of a bolt fastening method, a pin fastening method, and a multi-stage folding method.

The brake portion 140 may be formed of a brake structure coupled to a rolling shaft and may stop the roller portion 120 while being directly coupled to a rolling shaft of at least one of the first roller member 123 and the second roller member 124. To this end, the brake portion 140 may include a lever 142 having one side rotatably coupled to the support portion 130 and the other side extending to be operated by user, a coupling portion 144 coupled to the rolling shaft 125 of the first roller member 123 and configured to stop rolling of the first roller member 123 by pressing the first roller member 123 in the axial direction due to an operation of the lever 142, and a rolling prevention pin 146 configured to designate or limit a movement range of the lever 142 at the time the lever 142 is coupled or moved away. (At the time the lever is moved away, the lever is prevented from moving rearward to an extent that the lever becomes out of reach from a wheelchair user's hand)

A grip groove may be provided on an upper end of the lever 142 so that a user can easily grip the lever 142.

The coupling portion 144 may move in an axial direction of the first roller member 123 and be coupled to or moved away from the rolling shaft of the first roller member 123 due to an external force. At the time the coupling portion 144 is coupled, the coupling portion 144 may fix the rolling shaft of the first roller member 123 to stop rolling of the first roller member 123. Also, at the time the coupling portion 144 is moved away, the coupling portion 144 may release the first roller member 123 and allow rolling of the first roller member 123.

The rolling prevention pin 146 designates or limits the movement range of the lever 142 in a case in which the brake portion 140 is coupled to or moved away from the rolling shaft of the first roller member 123. Also, the rolling prevention pin 146 serves to prevent a user from exerting more than necessary force to the lever 142 at the time the brake portion 140 is coupled or moved away.

In a case in which the wheelchair 10 has entered the roller portion 120 for a user to exercise, the lever 142 of the brake portion 140 may be operated according to the user's operation so that the coupling portion 144 is moved away from the rolling shaft of the first roller member 123 and rolling of the first roller member 123 is allowed.

Also, in a case in which the wheelchair 10 exits through the footplate portion 110 for the user to end exercising, the lever 142 of the brake portion 140 may be operated according to the user's operation so that the coupling portion 144 is directly coupled to the rolling shaft of the first roller member 123 and rolling of the first roller member 123 is stopped. Here, the wheelchair 10 can easily exit through the footplate portion 110 using the stopped first roller member 123.

According to an embodiment of the present disclosure, the wheelchair treadmill 100 can help a wheelchair user do an aerobic exercise by rolling driving wheels of a wheelchair in place while in the wheelchair.

Also, according to an embodiment of the present disclosure, the wheelchair treadmill 100 can allow a wheelchair user to learn how to do an arm exercise and roll wheels of a wheelchair in a limited space.

Also, according to an embodiment of the present disclosure, the wheelchair treadmill 100 can use a slope of a roller member to prevent slippage of wheels.

Also, according to an embodiment of the present disclosure, the wheelchair treadmill 100 can be driven continuously and stably using a disc-type brake structure that comes in close contact in an axial direction.

The above description of the present disclosure is only illustrative, and those of ordinary skill in the art to which the present disclosure pertains should understand that the present disclosure may be easily modified in other specific forms without changing the technical spirit or essential features of the present disclosure. Therefore, the embodiments described above should be understood as illustrative, instead of limiting, in all aspects. For example, each element described as a single type may also be embodied in a distributed manner, and likewise, elements described as being distributed may also be embodied in a combined form.

The scope of the present disclosure is shown by the claims below, and all changes or modifications derived from the meaning and scope of the claims and their equivalents should be interpreted as belonging to the scope of the present disclosure.

The invention claimed is:

1. A wheelchair treadmill that supports home fitness of a wheelchair user, the wheelchair treadmill comprising:

a footplate portion configured to assist entry or exit of a wheelchair;

a roller portion which has a plurality of roller members disposed in parallel corresponding to left and right driving wheels of the wheelchair and configured to roll in a predetermined rolling direction due to rolling of each of the left and right driving wheels;

a support portion coupled to one side of the footplate portion and configured to rollably support the plurality of roller members; and a brake portion rotatably coupled to the support portion and configured to stop the roller portion by being coupled to a rolling shaft of the roller members, wherein the plurality of roller members include a first left roller member, a second left roller member, a first right roller member and a second right roller member, wherein the roller portion includes:

a pair of first left bearings installed at a front end of the support portion that is adjacent to the footplate portion, a pair of second left bearings spaced apart at a predetermined distance from the pair of first left bearings and installed at a rear end of the support portion, a pair of first right bearings installed at the front end of the support portion that is adjacent to the footplate portion, and a pair of second right bearings spaced apart at the predetermined distance from the pair of first right bearings and installed at the rear end of the support portion, wherein the first left roller member is rollably mounted on the pair of first left bearings, the second left roller member is rollably mounted on the pair of second left bearings, the first right roller member is rollably mounted on the pair of first right bearings, and the second right roller member is rollably mounted on the pair of second right bearings, wherein a diameter of the first left roller member increases toward an outer side of the first left roller member from a predetermined point of the first left roller member on which the left driving wheel is seated, and a slope of the first left roller member is formed at an angle that is upward from an inner side of the first left roller member toward the outer side of the first left roller member, wherein a diameter of the second left roller member increases toward an outer side of the second left roller member from a predetermined point of the second left roller member on which the left driving wheel is seated, and a slope of the second left roller member is formed at an angle that is upward from an inner side of the second left roller member toward the outer side of the second left roller member, wherein a diameter of the first right roller member increases toward an outer side of the first right roller member from a predetermined point of the first right roller member on which the right driving wheel is seated, and a slope of the first right roller member is formed at an angle that is upward from an inner side of the first right roller member toward the outer side of the first right roller member, and wherein a diameter of the second right roller member increases toward an outer side of the second right roller member from a predetermined point of the second right roller member on which the right driving wheel is seated, and a slope of the second right roller member is formed at an angle that is upward from an inner side of the second right roller member toward the outer side of the second right roller member.

2. The wheelchair treadmill of claim 1, wherein each of the plurality of roller members includes the rolling shaft and a roller body configured to roll about the rolling shaft.

3. The wheelchair treadmill of claim 1, wherein the support portion includes:

a first support member extending in a width direction of the footplate portion and coupled to one side of the footplate portion in a longitudinal direction of the footplate portion;

a pair of second support members extending in the longitudinal direction of the footplate portion and coupled to both sides of the first support member while being spaced apart at a predetermined distance therefrom; and a plurality of third support members coupled to a lower surface of each of the pair of second support members and configured to support the pair of second support members at a predetermined height from the ground.

4. The wheelchair treadmill of claim 1, wherein the brake portion includes:

a lever having one side rotatably coupled to the support portion and the other side extending to be operated by a user;

a coupling portion coupled to the rolling shaft of the first left roller member or the first right roller member and configured to stop rolling of the first roller member or the first right roller member by being directly coupled to the rolling shaft of the first roller member or the first right roller member due to operation of the lever; and a rolling prevention pin configured to designate or limit a movement range of the lever.

* * * * *